US011371122B2

(12) United States Patent
Orimo et al.

(10) Patent No.: US 11,371,122 B2
(45) **Date of Patent: *Jun. 28, 2022**

(54) MAGNETIC ALLOY POWDER AND METHOD FOR MANUFACTURING SAME, AS WELL AS COIL COMPONENT MADE OF MAGNETIC ALLOY POWDER AND CIRCUIT BOARD CARRYING SAME

(71) Applicant: TAIYO YUDEN CO., LTD., Tokyo (JP)

(72) Inventors: Yoko Orimo, Takasaki (JP); Tomoo Kashiwa, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 83 days.

This patent is subject to a terminal disclaimer.

(21) Appl. No.: 16/798,828

(22) Filed: Feb. 24, 2020

(65) Prior Publication Data

US 2020/0277689 A1 Sep. 3, 2020

(30) Foreign Application Priority Data

Feb. 28, 2019 (JP) ..... JP2019-036939
Dec. 18, 2019 (JP) ..... JP2019-227863

(51) Int. Cl.
*C22C 38/02* (2006.01)
*C22C 33/02* (2006.01)
(Continued)

(52) U.S. Cl.
CPC ..... *C22C 38/02* (2013.01); *C22C 33/0264* (2013.01); *C22C 33/04* (2013.01);
(Continued)

(58) Field of Classification Search
CPC ..... B22F 1/0088; B22F 1/02; C22C 2202/02; C22C 33/0228; C22C 33/04; C22C 38/02
(Continued)

(56) References Cited

U.S. PATENT DOCUMENTS 8,409,371 B2 * 4/2013 Watanabe ..... H01F 41/0246 148/276
2007/0243400 A1 * 10/2007 Miyahara ..... H01F 1/26 428/546
(Continued)

FOREIGN PATENT DOCUMENTS

JP 2006049625 A 2/2006
JP 2007299871 A 11/2007
(Continued)

*Primary Examiner* — Jie Yang
(74) *Attorney, Agent, or Firm* — Law Office of Katsuhiro Arai

(57) ABSTRACT

In an exemplary embodiment, a magnetic alloy powder is constituted by magnetic grains 100 whose alloy phase 1 is coated with an oxide film 2, wherein: the alloy phase 1 has a Fe content of 98 percent by mass or higher and also contains Si and at least one type of non-Si element that oxidizes more easily than Fe (element M); and the oxide film 2 is such that, at the location where the content of Si as expressed in percentage by mass is the highest according to the element distributions in the direction of film thickness, this content of Si is higher than the content of Fe, and also higher than the content of element M, at this location. The magnetic alloy powder has a high Fe content and also offers excellent insulating property.

7 Claims, 5 Drawing Sheets

(51) Int. Cl.

| | |
|---|---|
| ***C22C 38/18*** | (2006.01) |
| ***C22C 38/06*** | (2006.01) |
| ***C22C 33/04*** | (2006.01) |
| ***C22C 38/14*** | (2006.01) |

(52) U.S. Cl.
CPC ..... *C22C 38/06* (2013.01); *C22C 38/14* (2013.01); *C22C 38/18* (2013.01); *C22C 2202/02* (2013.01)

(58) Field of Classification Search
USPC ..... 148/307
See application file for complete search history.

(56) References Cited

U.S. PATENT DOCUMENTS

| | | | | |
|---|---|---|---|---|
| 2012/0070567 | A1* | 3/2012 | Watanabe | H01F 41/0246 427/127 |
| 2020/0279676 | A1* | 9/2020 | Orimo | B22F 1/0085 |

FOREIGN PATENT DOCUMENTS

| | | | | |
|---|---|---|---|---|
| JP | 2015070222 | A | | 4/2015 |
| JP | 2018182040 | A | * | 11/2018 |

* cited by examiner

Cross-Section A-A

MAGNETIC ALLOY POWDER AND METHOD FOR MANUFACTURING SAME, AS WELL AS COIL COMPONENT MADE OF MAGNETIC ALLOY POWDER AND CIRCUIT BOARD CARRYING SAME

CROSS-REFERENCE TO RELATED APPLICATIONS

The present application claims priority to Japanese Patent Application No. 2019-036939, filed Feb. 28, 2019 and 2019-227863, filed Dec. 18, 2019, the disclosures of which are incorporated herein by reference in their entirety including any and all particular combinations of the features disclosed therein.

BACKGROUND

Field of the Invention

The present invention relates to a magnetic alloy powder and a method for manufacturing the same, as well as a coil component made of the magnetic alloy powder and a circuit board carrying the same.

Description of the Related Art

Emergence of higher-performance electrical and electronic devices is driving the need, in recent years, for inductors and other coil components offering improved performance in smaller sizes. Since the performance of a coil component is affected by the quantity of the magnetic material contained therein, enhancing the performance of the magnetic material is necessary to reduce the size of the component, which inevitably leads to a decreased quantity of the magnetic material contained therein, while achieving higher performance at the same time.

Among coil components, those through which a relatively large electrical current flows are facing the requirement to reduce the changes in inductance caused by the electrical current. To meet this requirement, metals whose primary component is Fe are increasingly adopted as the magnetic material.

Any metal material whose primary component is Fe has conductive property, which means that compacting its powder into a magnetic body requires the grains constituting the powder to be electrically insulated from one another. For this reason, an insulating film is formed on the surface of each grain constituting the metal magnetic powder.

For example, Patent Literature 1 reports forming an insulating oxide film by oxidizing a metal magnetic powder with a composition of 9.4 percent by weight of Si, 5.2 percent by weight of Al, and Fe accounting for the rest, under the conditions of 850° C. for 1 hour in an oxygen-nitrogen mixture gas atmosphere of 2 percent by volume in oxygen concentration.

Also, Patent Literature 2 discloses a technical idea that involves forming a silicone resin layer on the grain surface of a pure-iron powder, compacting the powder, and then heat-treating it at a temperature of 600 to 650° C. in a non-oxidizing atmosphere to form an insulating film on the grain surface.

Furthermore, Patent Literature 3 reports putting Fe-1% Si atomized alloy grains through an oxidation reaction for 2 hours at 450° C. in an atmosphere of very low oxygen concentration that has been prepared by mixing water vapor into nitrogen gas and then adjusting the relative humidity to 100% (at room temperature), and consequently forming, on the grain surface, an insulating nano thin film constituted by an $SiO_2$ oxide film of 5 nm in film thickness.

BACKGROUND ART LITERATURES

[Patent Literature 1] Japanese Patent Laid-open No. 2007-299871

[Patent Literature 2] Japanese Patent Laid-open No. 2015-70222

[Patent Literature 3] Japanese Patent Laid-open No. 2006-49625

SUMMARY

As described in Patent Literature 1, forming an insulating film by heat-treating a metal magnetic powder in an oxidizing atmosphere requires that Al or other non-Fe element be contained in the metal by a certain quantity. This gives rise to the problem that a relatively lower Fe content in the metal prevents sufficient magnetic properties from being achieved.

As described in Patent Literature 2, on the other hand, adopting a metal magnetic powder of high Fe content such as that of pure iron makes it difficult to form an insulating film due to oxidization of a component in the metal, which necessitates the formation of an insulating film separately by coating the metal grain surface, etc. The insulating film thus formed is thick, and this gives rise to the problem that, upon compacting, the thickly formed insulating film increases the distance between metal grains due to the thickness of the insulating film, resulting in lower magnetic properties. Other problems include, for example, peeling, loss, etc., of the insulating film due to low adhesive strength between the metal grain and the insulating film, as well as higher coating treatment cost.

Also, as described in Patent Literature 3, forming an insulating film by oxidizing Si, which is a non-Fe component contained by a small quantity in the metal, in a weak oxidizing atmosphere can result in lower insulating property because of a thin, brittle $SiO_2$ oxide film peeling or cracking due to handling and thus causing the metal part to be exposed. Additionally, the metal part, when exposed to air, becomes prone to reacting with oxygen and being oxidized, which is another cause of lower magnetic properties. This limits the press tonnage when forming a compact, which in turn makes it difficult to achieve both desired insulating property and filling rate.

In light of the above, an object of the present invention is to solve the aforementioned problems and provide a magnetic alloy powder of high Fe content and excellent insulating property, as well as a simple method for manufacturing the same.

After conducting various studies to solve the aforementioned problems, the inventor of the present invention found that the problems could be solved by heat-treating, in the presence of oxygen, a magnetic alloy powder of very high Fe content which also contains Si and a non-Si element that oxidizes more easily than Fe, thereby forming a film of a Si-rich oxide on the surface of each grain constituting the magnetic alloy powder, and eventually completed the present invention.

To be specific, the first aspect of the present invention to solve the aforementioned problems is a magnetic alloy powder constituted by magnetic grains whose alloy phase is coated with an oxide film, wherein such magnetic alloy powder is characterized in that: the alloy phase has a Fe content of 98 percent by mass or higher and also contains Si and at least one type of non-Si element that oxidizes more easily than Fe (element M); and the oxide film is such that, at the location where the content of Si as expressed in percentage by mass is the highest according to the element distributions in the direction of film thickness, this content of Si is higher than the content of Fe, and also higher than the content of element M, at this location.

Also, the second aspect of the present invention is a method for manufacturing magnetic alloy powder constituted by magnetic grains whose alloy phase is coated with an oxide film, wherein such method for manufacturing magnetic alloy powder is characterized by including: preparing a material powder for magnetic alloy whose Fe content is 96.5 to 99 percent by mass and which also contains Si and at least one type of non-Si element that oxidizes more easily than Fe (element M); and heat-treating the material powder and thus forming an oxide film on the surface of each grain constituting the material powder, to obtain a magnetic alloy powder; wherein the magnetic alloy powder is such that: the content percentage of Fe in the alloy phase is higher than in the material powder; and at the location in the oxide film where the content of Si as expressed in percentage by mass is the highest according to the element distributions in the direction of film thickness, this content of Si is higher than the content of Fe, and also higher than the content of element M, at this location.

According to the present invention, a magnetic alloy powder having a high Fe content in the alloy and also offering excellent insulating property can be provided.

BRIEF DESCRIPTION OF THE DRAWINGS

(FIG. 3A: General perspective view, FIG. 3B: View of cross-section A-A in FIG. 3A)

(FIG. 4A: General perspective view, FIG. 4B: View of cross-section B-B in FIG. 4A)

DESCRIPTION OF THE SYMBOLS

Figure 1:
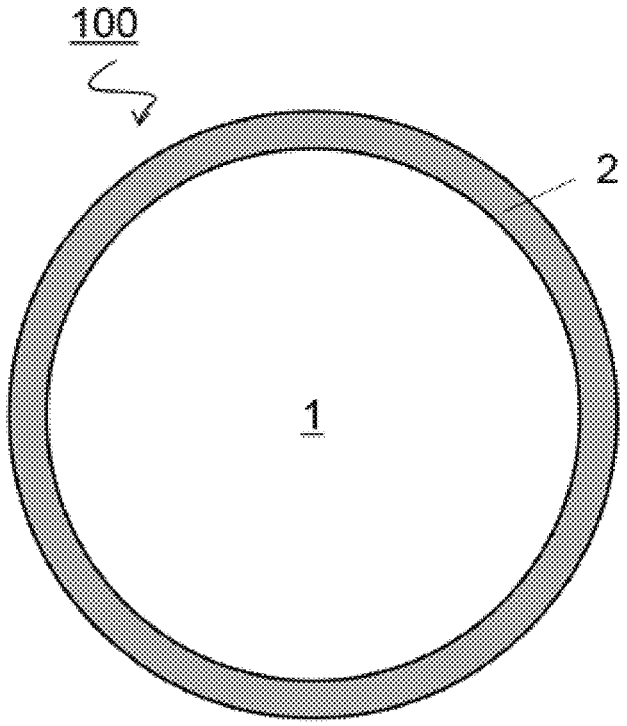
FIG. 1 is a schematic diagram illustrating the structure of a magnetic grain constituting the magnetic alloy powder pertaining to the first aspect of the present invention

100 Magnetic grain
1 Alloy phase
2 Oxide film

DETAILED DESCRIPTION OF ASPECTS

The constitutions as well as operations and effects of the present invention are explained below, together with the technical concepts, by referring to the drawings. It should be noted, however, that the mechanisms of operations include estimations and whether they are right or wrong does not limit the present invention in any way. Also, of the components in the aspects below, those components not described in the independent claims representing the most generic concepts are explained as optional components. It should be noted that a description of numerical range (description of two values connected by "to") is interpreted to include the described values as the lower limit and the upper limit.

[Magnetic Alloy Powder]

The magnetic alloy powder pertaining to the first aspect of the present invention (hereinafter also referred to simply as "first aspect") is constituted by magnetic grains 100 whose alloy phase 1 is coated with an oxide film 2, as shown in FIG. 1; wherein the magnetic alloy powder is characterized in that: the alloy phase 1 has a Fe content of 98 percent by mass or higher and also contains Si and at least one type of non-Si element that oxidizes more easily than Fe (hereinafter also referred to as "element M"); and the oxide film 2 is such that, at the location where the content of Si as expressed in percentage by mass is the highest according to the element distributions in the direction of film thickness, this content of Si is higher than the content of Fe, and also higher than the content of element M, at this location.

The alloy phase 1 in the first aspect contains Fe by 98 percent by mass or more as a constituent element. Due to the high content of Fe in the alloy phase part, excellent magnetic permeability and other magnetic properties will be achieved when a magnetic body is formed. Preferably the content of Fe in the alloy phase 1 is adjusted to 99 percent by mass or higher.

The alloy phase 1 contains Si and at least one type of element M, in addition to Fe. Because the alloy phase 1 contains Si, an oxide film 2 having high electrical insulating property and smooth surface can be formed on the surface of the magnetic grain. Also, because element M is contained, oxidation of Fe being a primary component of the alloy phase 1 can be restrained, and therefore when a magnetic body is formed, stable magnetic permeability and other magnetic properties will be achieved.

Element M may be Cr, Al, Ti, Zr, Mg, and the like. Of these, Cr or Al is preferred from the viewpoint of high Fe oxidation restraint effect, and Cr is particularly preferred.

Only one type of element M may be contained, or two or more types may be contained, in the alloy phase 1.

A first aspect of the invention is constituted by magnetic grains 100 whose alloy phase 1 is coated with an oxide film 2.

The oxide film 2 on the surface of the magnetic grain 100 is such that, at the location where the content of Si as expressed in percentage by mass is the highest according to the element distributions in the direction of film thickness, this content of Si is higher than the content of Fe, and also higher than the content of element M, at this location. This means that the oxide film 2 has a thin layer containing Si in the largest quantity as its constituent element. Such thin layer has excellent insulating property, and therefore the oxide layer 2 and magnetic grain 100 having this layer exhibit high insulating property.

Preferably the oxide film 2 on the surface of the magnetic grain 100 is such that the total content of Si is higher than the total content of Fe and also higher than the total content of element M. When the oxide film 2 is rich in Si, much higher insulating property can be achieved.

Also, preferably the oxide layer 2 contains element M. When the oxide film 2 contains element M, oxidation of Fe in the alloy phase 1 positioned inside is restrained and, when a magnetic body is formed, the magnetic permeability and other magnetic properties will become stable.

Here, the method below is used to measure the percentage by mass of each element in the alloy phase 1 and in the oxide film 2. Using an X-ray photoelectron spectrometer (PHI Quantera II, manufactured by ULVAC-PHI, Inc.), the content percentage (percent by atom) of each element such as iron (Fe) is measured at the surface of the magnetic grain constituting the magnetic alloy powder, and then the grain surface is sputtered, and by repeating the foregoing, a distribution of each element is obtained in the depth direction (diameter direction) of the grain. The measurement of the content percentage of each element is performed in steps of 5 nm based on a detection area of 100 μmϕ, using a monochromatized AlKα ray as an X-ray source. Also, the sputtering conditions are such that argon (Ar) is used as a sputter gas and the impressed voltage is set to 2.0 kV and sputter rate, to approx. 5 nm/min (in equivalent $SiO_2$ value). On the Fe concentration distribution (percent by atom) obtained by the measurement, the section between measurement points where the concentration difference between the measurement points drops below 1 percent by atom for the first time when viewed from the surface side of the grain, is defined as the boundary between the alloy phase 1 and the oxide film 2. Then, the percentages by mass (percent by mass) of elements are calculated for the oxide film 2 representing a shallower area, and for the alloy phase 1 representing a deeper area, with respect to the boundary. In an exemplary embodiment, the composition of the alloy phase (or the oxide film) is an average composition of the alloy part (or the oxide film) in its entirety, which can be determined by sputtering the grain in the depth direction until the composition distribution become substantially constant in the depth direction, thereby obtaining the composition distribution in the depth direction of the alloy phase in its entirety without sputtering the grain in its entirety (alternatively, in another embodiment, a representative composition of a randomly selected region, a representative composition of a measured region, or the like, represents the composition of the alloy phase or the oxide film).

In the first aspect, preferably Si, and all of elements M that are contained in the alloy phase 1, are contained throughout the oxide film 2. The fact that these elements are contained throughout the oxide film 2 indicates that the oxide film 2 has been formed as a result of diffusion of the components in the alloy phase 1. The magnetic alloy powder, whose oxide film 2 has been formed through this process, is such that, within the grain constituting the powder, the distribution of each element continues from the inside of the grain to the outer periphery of the grain, and therefore any stress generating inside the grain can be reduced. This, in turn, restrains the magnetic permeability of the grain itself from dropping.

Here, that Si, and all of elements M that are contained in the alloy phase 1, are contained throughout the oxide film 2 can be confirmed by the detection of each of these elements at all measurement points that are positioned in the area identified as the oxide film 2, in the aforementioned distribution of each element in the depth direction (diameter direction) as obtained by the measurement of percentage by mass of each element in the alloy phase 1 and in the oxide film 2.

To obtain the magnetic grain 100 where Si, and all of elements M that are contained in the alloy phase 1, are contained throughout the oxide film 2, it is effective to heat-treat the material powder for magnetic alloy in a low-oxygen atmosphere (roughly 5 to no higher than 500 ppm), as described below. Use of such oxidizing atmosphere restrains sudden oxidation reaction. This way, the elements that oxidize more easily than Fe can be oxidized selectively. In particular, oxidation of Si, as an element that oxidizes more easily than Fe, can be promoted. It should be added that, in an atmosphere of oxygen levels lower than the above-mentioned level, a similar oxidation reaction can be achieved, but a longer heat treatment time will be required and the range where oxygen is supplied will likely be limited, which can cause variability in the oxidation reaction due to contact between grains or lack thereof. For this reason, use of a low-oxygen atmosphere like the one mentioned above is preferred.

In the first aspect, preferably the oxide film 2 has a thickness of 10 nm or more. By adjusting the thickness of the oxide film 2 at 10 nm or more, the electrical insulating property between the magnetic grains 100 can be enhanced further. In addition, contacting of the alloy phase 1 with air is prevented even when the oxide film 2 is damaged due to handling, and oxygen in the air is also restrained from diffusing to and reaching the metal part, which can restrain the magnetic properties from dropping due to oxidation of Fe. More preferably the thickness of the oxide film 2 is 20 nm or more.

Although its upper limit is not limited in any way, preferably the thickness of the oxide film 2 is 500 nm or less. By keeping the thickness of the oxide film 2 to 500 nm or less, smoothness of the surface of the oxide film 2 can be maintained. A thickness of more than 500 nm means the percentages of components other than Si are higher, which makes the surface prone to concavities and convexities. More preferably the thickness of the oxide film 2 is 200 nm or less. By keeping the thickness of the oxide film 2 to 200 nm or less, generation of cracks and chips in the oxide film 2 due to grain collision, etc., as a result of handling can be restrained. Also, when a magnetic body is formed, high magnetic permeability can be obtained. Even more preferably the thickness of the oxide film 2 is 100 nm or less. Furthermore, from the viewpoint of increasing the surface smoothness of the magnetic grain 100 to provide a magnetic alloy powder offering excellent flowability, preferably the thickness of the oxide film 2 is 50 nm or less.

Here, the thickness of the oxide film 2 is calculated by observing the cross-sections of magnetic grains 100 constituting the magnetic alloy powder using a scanning transmission electron microscope (STEM) (JEM-2100F, manufactured by JEOL Ltd.) and, by focusing on the oxide film 2 as recognized by a contrast (brightness) difference (attributed to different compositions) from the alloy phase 1 inside the grain, measuring its thickness at randomly selected 10 locations on different grains, respectively, at a magnification of 500,000 times and then averaging the results.

The grain size in the first aspect is not limited in any way and, for example, the average grain size (median diameter ($D_{50}$)) calculated from the granularity distribution measured on volume basis may be adjusted to 0.5 to 30 μm. Preferably the average grain size is adjusted to 1 to 10 μm. This average grain size can be measured with, for example, a granularity distribution measuring device utilizing the laser diffraction/scattering method.

Also, in the first aspect, preferably the relationship between the specific surface area S ($m^2/g$) and the average grain size $D_{50}$ (μm) satisfies Formula (1) below.

[Math. 1]

$$\log S \leq -0.98 \log D_{50} + 0.34 \quad (1)$$

This formula is derived based on the empirical rule that the common logarithm of specific surface area S ($m^2/g$), and the common logarithm of average grain size $D_{50}$ (μm), have a linear relationship. Since the value of specific surface area of a powder is affected not only by the surface concavities and convexities of the grains constituting the powder, but also by the sizes of the grains, it cannot be asserted that a powder with a smaller value of specific surface area is constituted by smooth grains having fewer surface concavities and convexities. Accordingly, the impact of the surface condition of the grain, and the impact of the grain size, on the specific surface area, are isolated according to Formula (1) above, and a magnetic alloy powder having a smaller specific surface area due to the former impact is considered to have a smooth surface with fewer concavities and convexities. When the relationship of S and $D_{50}$ satisfies Formula (1) above, a powder of excellent flowability will be obtained.

The relationship between the specific surface area S ($m^2/g$) and the average grain size $D_{50}$ (μm) preferably satisfies Formula (2) below, or more preferably satisfies Formula (3) below.

[Math. 2]

$$\log S \leq -0.98 \log D_{50} + 0.30 \quad (2)$$

[Math. 3]

$$\log S \leq -0.98 \log D_{50} + 0.25 \quad (3)$$

Here, the specific surface area S is measured/calculated with a fully-automated specific surface area measuring device (Macsorb, manufactured by MOUNTECH Co., Ltd.) using the nitrogen gas adsorption method. First, the measurement sample is deaerated in a heater, after which nitrogen gas is adsorbed and desorbed onto/from the measurement sample, to measure the adsorbed nitrogen quantity. Next, the monomolecular layer adsorption quantity is calculated from the obtained adsorbed nitrogen quantity using the BET 1-point method, and from this value, the surface area of the sample is derived using the area occupied by one nitrogen molecule and the value of Avogadro's number. Lastly, the obtained surface area of the sample is divided by the mass of the sample, to obtain the specific surface area S of the powder.

Also, the average grain size $D_{50}$ is measured/calculated with a granularity distribution measuring device (LA-950, manufactured by Horiba, Ltd.) that utilizes the laser diffraction/scattering method. First, water is put in a wet flow cell as a dispersion medium, and the powder that has been fully crushed beforehand is introduced to the cell at a concentration that allows appropriate detection signals to be obtained, in order to measure the granularity distribution. Next, the median diameter is calculated from the obtained granularity distribution, and this value is defined as the average grain size $D_{50}$.

[Method for Manufacturing Magnetic Alloy Powder]

The method for manufacturing magnetic alloy powder pertaining to a second aspect of the present invention (hereinafter also referred to simply as "second aspect") includes: preparing a material powder for magnetic alloy whose Fe content is 96.5 to 99 percent by mass and which also contains Si and at least one type of element M; and heat-treating the material powder to obtain a magnetic alloy powder whose alloy phase is coated with an oxide film. Also, the magnetic alloy powder is such that: the content percentage of Fe in the alloy phase is higher than in the material powder; and at the location in the oxide film where the content of Si as expressed in percentage by mass is the highest according to the element distributions in the direction of film thickness, this content of Si is higher than the content of Fe, and also higher than the content of element M, at this location.

The material powder for magnetic alloy used in the second aspect contains Fe, as a constituent element, by 96.5 to 99 percent by mass. By adjusting the content of Fe to 96.5 percent by mass or higher, a magnetic alloy powder having an alloy phase of high Fe content can be obtained by the heat treatment mentioned below, and when a magnetic body is formed, excellent magnetic permeability and other magnetic properties will be achieved. Preferably the content of Fe is 97 percent by mass or higher. On the other hand, adjusting the content of Fe to 99 percent by mass or lower restrains Fe from oxidizing as a result of the heat treatment mentioned below, which in turn allows for restraint of drop in the magnetic permeability and other magnetic properties. Preferably the content of Fe in the alloy phase is 98 percent by mass or lower.

The material powder contains Si, in addition to Fe. Because the material powder contains Si, a Si-rich oxide film can be formed on the surface of the magnetic grain due to the heat treatment mentioned below, and high electrical insulating property can be achieved as a result.

Also, the material powder contains at least one type of element M. Because the material powder contains element M, the heat treatment mentioned below causes element M to diffuse over the surface of the magnetic grain, and an oxide film containing element M will be formed as a result. This can restrain oxidation of Fe and consequent drop in magnetic permeability and other magnetic properties. The content of element M is not limited in any way, but from the viewpoint of effectively restraining Fe from oxidizing, it is preferably 0.2 percent by mass or higher, or more preferably 0.5 percent by mass or higher.

Element M may be Cr, Al, Ti, Zr, Mg, and the like. Of these, Cr or Al is preferred from the viewpoint of high Fe oxidation restraint effect, and Cr is particularly preferred.

Only one type of element M may be contained, or two or more types may be contained, in the alloy phase.

The grain size of the material powder is not limited in any way and, for example, the average grain size (median diameter ($D_{50}$)) calculated from the granularity distribution measured on a volume basis may be adjusted to 0.5 to 30 μm. Preferably the average grain size is adjusted to 1 to 10 μm. This average grain size can be measured with, for example, a granularity distribution measuring device utilizing the laser diffraction/scattering method.

In the second aspect, preferably the material powder is heat-treated in an atmosphere of 5 to 500 ppm in oxygen concentration. By keeping the oxygen concentration in this range, oxidation of Si will be promoted, while oxidation of components other than Si will be restrained. As a result, a Si-rich oxide film can be formed to ensure a surface condition of fewer concavities and convexities. In addition, adjusting the oxygen concentration in the heat treatment atmosphere to 5 ppm or higher promotes diffusion of Si to the magnetic grain surface, thereby allowing for formation of a Si-rich oxide film offering excellent electrical insulating performance. Also, at the same time, diffusion of element M will also be promoted and the oxide film will contain element M, which can effectively restrain Fe in the alloy from oxidizing. The oxygen concentration in the heat treatment atmosphere is more preferably adjusted to 50 ppm or higher, or yet more preferably adjusted to 100 ppm or higher.

On the other hand, performing heat treatment in a low-oxygen atmosphere allows for formation, on the magnetic grain surface, of an oxide film having a smooth surface with fewer fine concavities and convexities, and accordingly the oxygen concentration in the heat treatment atmosphere is adjusted preferably to 500 ppm or lower, or more preferably to 400 ppm or lower, or yet more preferably to 300 ppm or lower.

Preferably the temperature at which to heat-treat the material powder is 600° C. or higher. By keeping the heat treatment temperature to 600° C. or higher, Si will diffuse fully over the surfaces of individual grains constituting the material powder, and an oxide film of high electrical insulating property will be formed, while the content percentage of Fe in the alloy phase will increase, improving the magnetic permeability and other magnetic properties. Also, at the same time, element M will also diffuse fully and the oxide film will contain that element, which can effectively restrain Fe in the alloy from oxidizing. The heat treatment temperature is more preferably 650° C. or higher, or yet more preferably 700° C. or higher. The upper limit of heat treatment temperature is not limited in any way, but from the viewpoint of restraining excessive oxidation of Fe and obtaining a magnetic body offering excellent magnetic properties, it is adjusted preferably to 850° C. or lower, or more preferably to 800° C. or lower, or yet more preferably to 750° C. or lower.

Preferably the period over which to heat-treat the material powder is 4 hours or longer. Such heat treatment restraints oxidation of Fe, while promoting oxidation of components other than Fe, thereby allowing the content percentage of Fe to increase over the level in the material powder. This increases the content percentage of Fe within the alloy phase, which in turn allows for enhancement in the magnetic saturation properties. Also, the magnetic permeability and loss properties can be maintained by causing Si to oxidize while allowing Si to remain in the alloy phase. A microscopic explanation for this is that a long period of heat treatment causes Si and element M contained in the material powder to diffuse fully to the magnetic grain surface, thereby increasing the content percentage of Fe in the alloy phase and improving the magnetic permeability and other magnetic properties. The heat treatment period is adjusted preferably to 5 hours or longer, or more preferably to 10 hours or longer. The upper limit of heat treatment period is not limited in any way, but from the viewpoint of completing the heat treatment quickly and thus improving productivity, the heat treatment period is adjusted preferably to 24 hours or shorter, or more preferably to 12 hours or shorter.

The heat treatment in the second aspect may be a batch process or flow process. Examples of a flow process include a method whereby multiple heat-resistant containers carrying the material powder for magnetic alloy are introduced into a tunnel furnace either intermittently or successively, to have them pass through an area, which is kept at a prescribed atmosphere and a prescribed temperature, over a prescribed period of time.

According to the aforementioned first aspect and second aspect, a magnetic alloy powder of high Fe content and excellent insulating property is obtained. According to this magnetic alloy powder, high-performance coil components can be obtained. Among the coil components manufactured from magnetic alloy powders, the so-called composite coil components, or specifically coil components having a coil part and a core part in which the coil part is embedded, where the core part contains a magnetic alloy powder and a resin, benefit significantly from the aforementioned advantages according to the first aspect and second aspect and therefore these components offer excellent magnetic properties, durability, and reliability while also permitting component size reduction. In addition, performance enhancement and size reduction of circuit boards carrying such coil components are also possible. In light of the above, a composite coil component, and a circuit board, both representing a preferred mode of the present invention, are explained below as a third aspect and a fourth aspect, respectively.

[Coil Component]

The coil component pertaining to the third aspect of the present invention (hereinafter also referred to simply as "third aspect") is a coil component that includes a coil part constituted by a metal conductor and a magnetic base body containing magnetic alloy grains, characterized in that the magnetic alloy grains are magnetic alloy grains constituting the magnetic alloy powder pertaining to the first aspect.

As for the placement of the coil part, it may be embedded in the magnetic base body. Or, it may be wound around the magnetic base body.

The magnetic base body contains magnetic alloy grains constituting the magnetic alloy powder pertaining to the first aspect.

The structure of the magnetic base body may be such that it contains a resin in addition to magnetic alloy grains, and that its shape is retained by the action of the resin. Or, its shape may be retained by bonds between magnetic alloy grains through the aforementioned oxide films.

Figure 2:
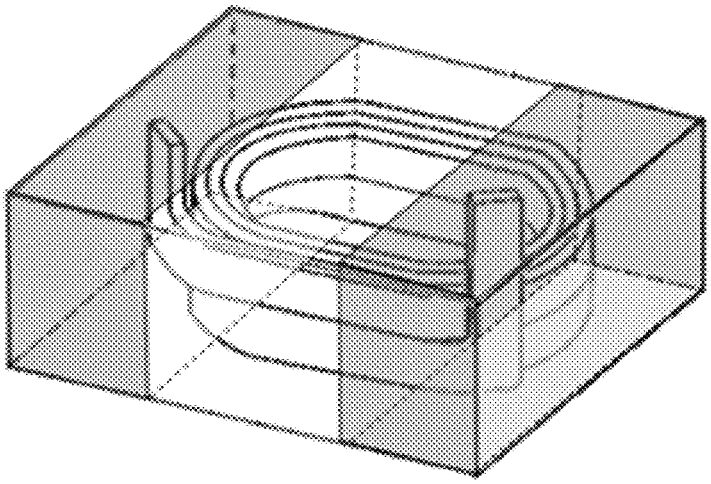
FIG. 2 is a drawing explaining a structural example of a composite coil component pertaining to an aspect of the present invention
Figure 3A:
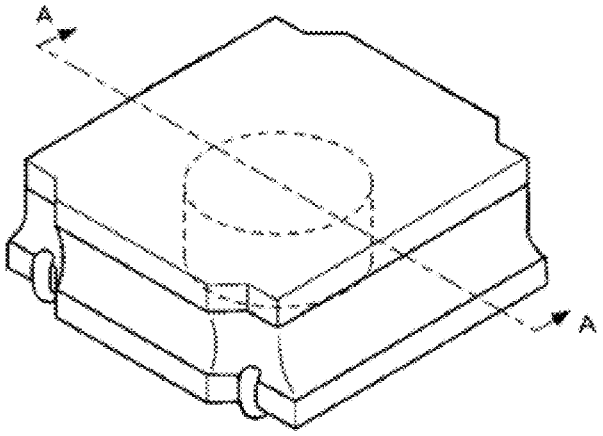
FIGS. 3A to 3B are drawings explaining a structural example of a wound coil component pertaining to an aspect of the present invention
Figure 3B:
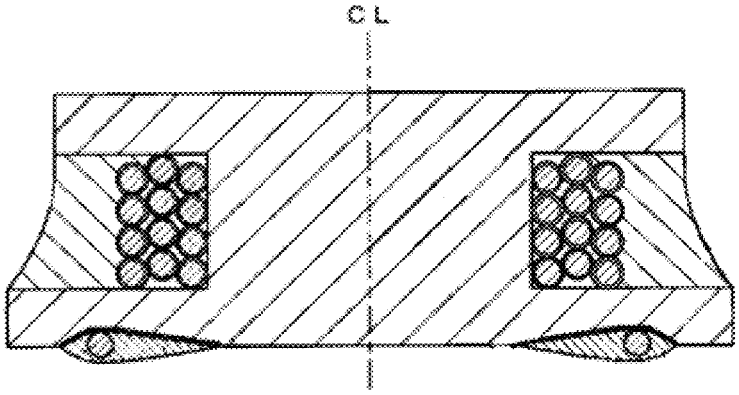
Figure 4A:
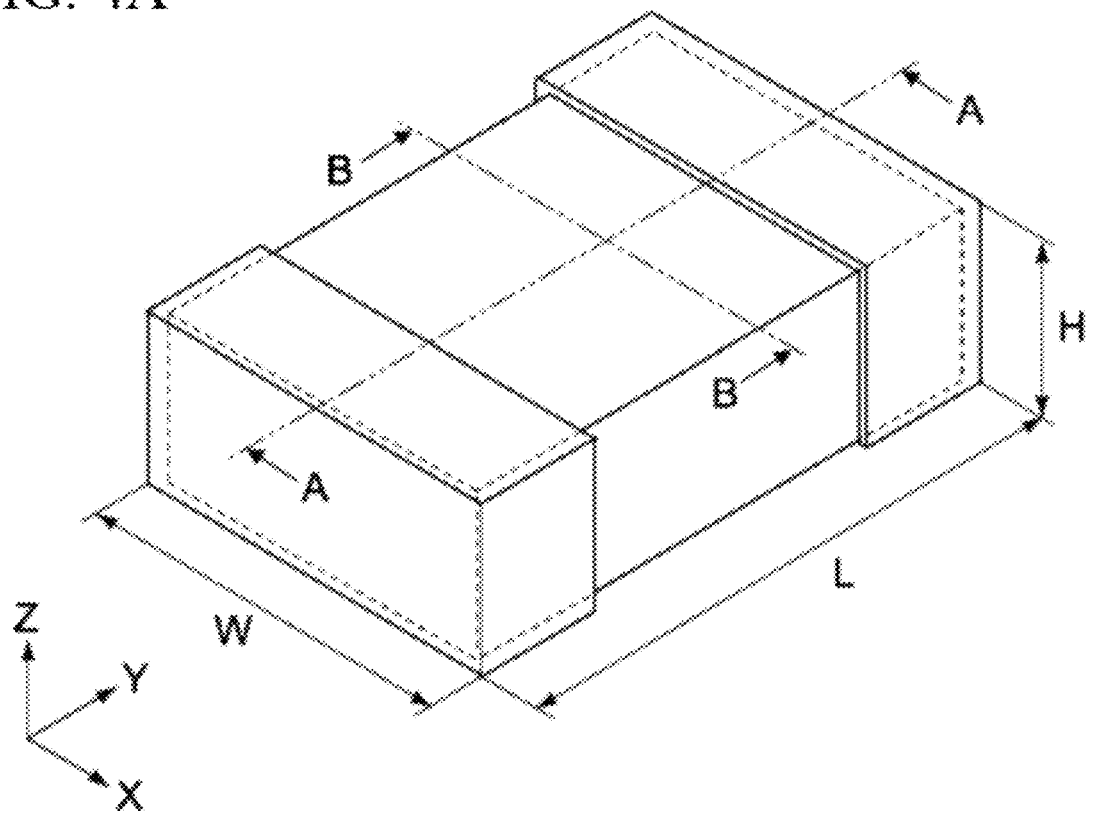
FIGS. 4A to 4B are drawings explaining a structural example of a multilayer coil component pertaining to an aspect of the present invention
Figure 4B:
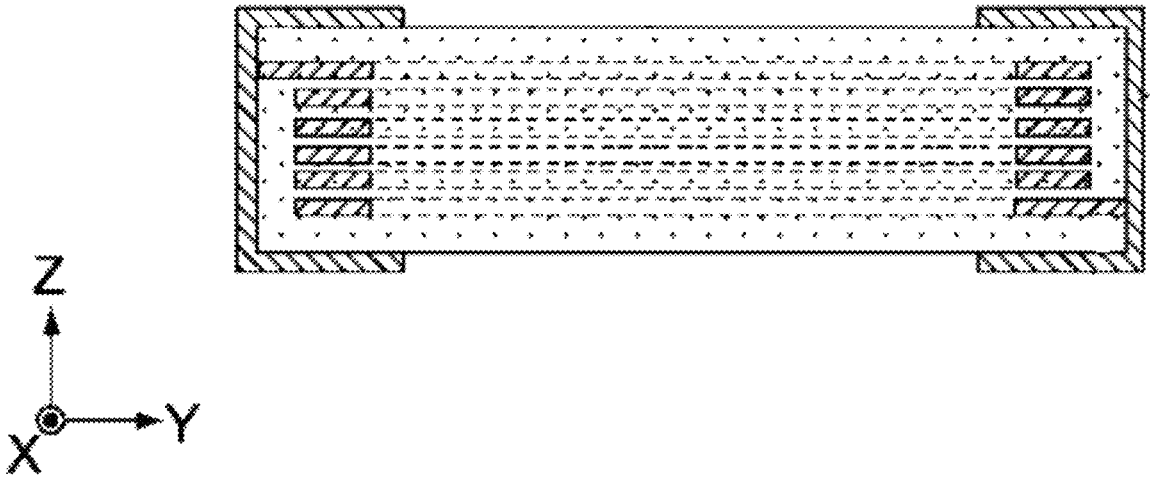
Figure 5:
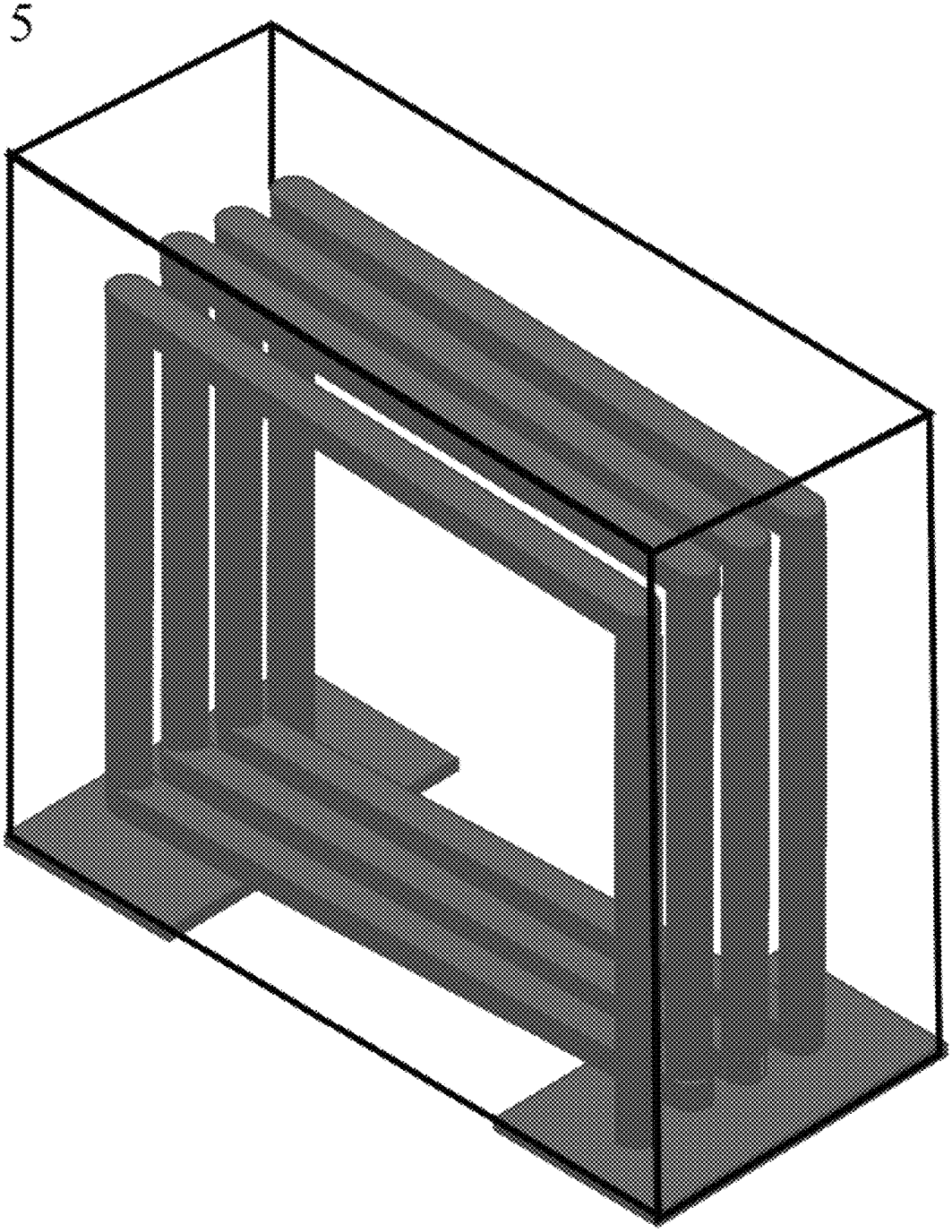
FIG. 5 is a drawing explaining a structural example of a thin-film coil component pertaining to an aspect of the present invention

Examples of the third aspect include, for example, a composite coil component such as the one shown in FIG. 2, a wound coil component such as the one shown in FIGS. 3A to 3B, a multilayer coil component such as the one shown in FIGS. 4A to 4B, and a thin-film coil component such as the one shown in FIG. 5.

As for the method for manufacturing the third aspect, in the case of a composite coil component, for example, it is typically obtained by mixing a magnetic alloy powder with a resin to prepare a mixture, and then introducing the mixture into a metal die or other mold in which a hollow coil has been placed beforehand, followed by press-forming and curing of the resin.

The magnetic alloy powder to be used was already described above and is therefore not explained.

The resin to be used is not limited in type, so long as it can bond the magnetic metal powder grains together to form and retain a shape, and any of various resins such as epoxy resins, silicone resins, etc., may be used. The use quantity of resin is not limited in any way, either, and may be 1 to 10 parts by mass relative to 100 parts by mass of magnetic alloy powder, for example. When a magnetic alloy powder obtained by the method pertaining to the second aspect, in which the material powder is heat-treated in a low oxygen atmosphere, is used, the use quantity of resin is preferably 3 parts by mass or less relative to 100 parts by mass of magnetic alloy powder because it offers excellent flowability, allowing for reduction of the use quantity of resin and thus increasing the proportion of magnetic alloy powder.

The methods for mixing the magnetic alloy powder with the resin and introducing the mixture into a mold, are not limited in any way, either, and a method of introducing a liquid mixture produced by kneading the two, as well as a method of introducing into a mold a granulated powder of a magnetic alloy whose surface has been coated with a resin, may be adopted, among others. Additionally, as a method for introducing the mixture into a mold and performing press-forming at the same time, one whereby the mixture is formed into a sheet and introduced into a mold by a press machine may be adopted.

The press-forming temperature and tonnage are not limited in any way, either, and may be determined as deemed appropriate according to the material and shape of the hollow coil placed in the mold, flowability of the magnetic alloy powder introduced, and type and quantity of the resin introduced, and the like.

The resin curing temperature, too, may be determined as deemed appropriate according to the resin used.

The magnetic base body pertaining to the third aspect may be formed by press-forming a mixture of magnetic alloy powder and resin, and then heat-treating the obtained compact at a temperature higher than the resin curing temperature. In this case, the heat treatment breaks down the resin and also allows oxide films to grow on the surfaces of the magnetic alloy grains, thereby causing the magnetic alloy grains to bond together via the oxide films. It should be noted that, while the resin component will break down almost entirely due to the heat treatment, carbon may partially remain.

When a wire is wound around the magnetic base body thus obtained, a wound coil component can be obtained. A wound coil component is also one example of the coil component in the third aspect.

Also, when the coil component is a multilayer coil component, it may be manufactured using the sheet method. As for the procedure under the sheet method, first a magnetic alloy powder is mixed with a resin to prepare a mixture, which is then applied in a sheet form using the doctor blade method, etc., and the sheet is cut, after which via holes are created at prescribed positions using a laser, etc., and internal patterns are printed at prescribed positions. Next, sheets that have been prepared in this manner are stacked in a prescribed order and then thermally compressed to obtain a laminate. Next, if necessary, the laminate is cut to the sizes of individual components using a dicer, laser cutting machine, or other cutting machine. Lastly, each of these laminates is heat-treated to obtain a multilayer coil component. A multilayer coil component is also one example of the coil component in the third aspect.

Furthermore, when the coil component is a thin-film coil component, photolithography may be adopted. A thin-film coil component is also one example of the coil component of the third aspect.

It goes without saying that, in addition to the manufacturing methods illustrated above, any known manufacturing method may be adopted according to the shape of the coil component, etc.

The third aspect provides a high-performance coil component because it uses, for the magnetic alloy powder, one of high Fe content and excellent insulating property. As a result, the element volume needed to achieve a target inductance can be reduced, and consequently the coil component can be made smaller.

[Circuit Board]

The circuit board pertaining to the fourth aspect of the present invention (hereinafter also referred to simply as "fourth aspect") is a circuit board carrying the coil component pertaining to the third aspect.

The circuit board is not limited in structure, etc., and anything that fits the purpose may be adopted.

The fourth aspect, by using the coil component pertaining to the third aspect, allows for performance enhancement and size reduction.

EXAMPLES

The present invention is explained more specifically below using examples; it should be noted, however, that the present invention is not limited to these examples.

Example 1

A material powder for magnetic alloy, having a composition of 96 percent by mass of Fe, 2 percent by mass of Si, 1 percent by mass of Cr, and 1 percent by mass of Al, and an average grain size of 4.0 μm, was put in a container made of zirconia and placed in a vacuum heat treatment furnace.

Next, the interior of the furnace was evacuated to an oxygen concentration of 5 ppm, after which the temperature was raised to 650° C. at a rate of temperature rise of 5° C./min and held at that temperature for 5 hours to perform heat treatment, and then the furnace was cooled to room temperature, to obtain the magnetic alloy powder pertaining to Example 1.

When the obtained magnetic alloy powder was measured, according to the aforementioned method, for the percentage by mass of each element in the alloy phase of the magnetic grain constituting the powder, Fe accounted for 98.0 percent by mass, Si accounted for 1.0 percent by mass, Cr accounted for 0.8 percent by mass, and Al accounted for 0.2 percent by mass.

Also, when the obtained magnetic alloy powder was measured, according to the aforementioned method, for the percentage by mass of each element in the oxide film of the magnetic grain constituting the powder, it was confirmed that, at the measurement position where the content of Si was the highest, Si was the element contained in the largest quantity and that Cr and Al were also contained at the above measurement position.

Furthermore, when the obtained magnetic alloy powder was measured, according to the aforementioned method, for the thickness of the oxide film formed on the surface of the magnetic grain, the result was 20 nm.

Example 2

The magnetic alloy powder pertaining to Example 2 was obtained in the same manner as in Example 1, except that the oxygen concentration in the heat treatment atmosphere was changed to 100 ppm.

When the obtained magnetic alloy powder was measured, according to the same method in Example 1, for the percentage by mass of each element in the alloy phase of the magnetic grain constituting the powder, Fe accounted for 98.1 percent by mass, Si accounted for 0.8 percent by mass, Cr accounted for 0.7 percent by mass, and Al accounted for 0.4 percent by mass.

Also, when the obtained magnetic alloy powder was measured, according to the same method in Example 1, for the percentage by mass of each element in the oxide film of the magnetic grain constituting the powder, it was confirmed that, at the measurement position where the content of Si was the highest, Si was the element contained in the largest quantity and that Cr and Al were also contained at the above measurement position.

Furthermore, when the obtained magnetic alloy powder was measured, according to the same method in Example 1, for the thickness of the oxide film formed on the surface of the magnetic grain, the result was 45 nm.

Example 3

The magnetic alloy powder pertaining to Example 3 was obtained in the same manner as in Example 1, except that the holding time during heat treatment was changed to 10 hours.

When the obtained magnetic alloy powder was measured, according to the same method in Example 1, for the percentage by mass of each element in the alloy phase of the magnetic grain constituting the powder, Fe accounted for 98.3 percent by mass, Si accounted for 1.7 percent by mass, Cr accounted for 0.6 percent by mass, and Al accounted for 0.4 percent by mass.

Also, when the obtained magnetic alloy powder was measured, according to the same method in Example 1, for the percentage by mass of each element in the oxide film of the magnetic grain constituting the powder, it was confirmed that, at the measurement position where the content of Si was the highest, Si was the element contained in the largest quantity and that Cr and Al were also contained at this measurement position.

Comparative Example 1

A material powder for magnetic alloy, having a composition of 96 percent by mass of Fe, 2 percent by mass of Si, and 2 percent by mass of Cr, and an average grain size of 4.0 μm, was put in a container made of zirconia and placed in a heat treatment furnace.

Next, the temperature was raised to 650° C. at a rate of temperature rise of 5° C./min in the atmosphere of air and held at that temperature for 5 hours to perform heat treatment, after which the furnace was cooled to room temperature, to obtain the magnetic alloy powder pertaining to Comparative Example 1.

When the obtained magnetic alloy powder was measured, according to the aforementioned method, for the percentage by mass of each element in the alloy phase of the magnetic grain constituting the powder, Fe accounted for 97.3 percent by mass, Si accounted for 1.8 percent by mass, and Cr accounted for 0.9 percent by mass.

Also, when the obtained magnetic alloy powder was measured, according to the same method in Example 1, for the percentage by mass of each element in the oxide film of the magnetic grain constituting the powder, it was confirmed that, at the measurement position where the content of Si was the highest, Cr was the element contained in the largest quantity and that Si was also contained at this measurement position.

Comparative Example 2

The magnetic alloy powder pertaining to Comparative Example 2 was obtained in the same manner as in Example 3, except that, for the material powder for magnetic alloy, one having a composition of 98 percent by mass of Fe and 2 percent by mass of Si, and an average grain size of 4.0 μm, was used.

When the obtained magnetic alloy powder was measured, according to the same method in Example 1, for the thickness of the oxide film formed on the surface of the magnetic grain, the result was 320 nm. It is understood that, in this comparative example, the absence of element M in the material powder promoted oxidation of Si during the heat treatment and thereby caused a thick oxide film to be formed.

From comparing the compositions of the material powders and magnetic alloy powders in Examples 1, 2, and 3, it was found that the heat treatment caused the percentage by mass of Fe to increase, while causing the percentages by mass of Si, Cr, and Al to decrease, by contrast, in the alloy phase. In the oxide film formed on the surface of the magnetic grain constituting the magnetic alloy powder, the percentages by mass of Si, Cr, and Al were higher than those in the alloy phase; accordingly, it is argued that the heat treatment caused Si, Cr, and Al in the alloy phase to diffuse to the magnetic grain surface and form an oxide.

Since the magnetic alloy powders pertaining to the examples have a high percentage by mass of Fe in the alloy phase of the magnetic grain, it is argued that they can form coil components subject to less variation in inductance relative to the electrical current. Additionally, since they have a Si-rich oxide film formed on the surface of the magnetic grains, it is argued that the magnetic alloy powders pertaining to the examples exhibit excellent insulating property. Furthermore, since they contain Cr or Al as element M in the oxide film, it is argued that the magnetic alloy powders pertaining to the examples exhibit excellent oxidation resistance. In fact, when the magnetic alloy powders pertaining to the examples were let stand in the air for several days and then measured for the composition of the magnetic grain and thickness of the oxide film, no changes were observed.

[Example 4] (Evaluation in Coil Component State)

The magnetic alloy powder pertaining to Example 1 was kneaded with a resin and the resulting mixture was filled in a mold in which a hollow coil had been placed, followed by press-forming and subsequent heating to cure the resin, to obtain a magnetic body. Electrodes were formed on the surface of the magnetic body and made electrically continuous with the coil, to provide a coil component.

The obtained coil component, as expected from the structure of the magnetic grain constituting the magnetic alloy powder, or specifically from the structure marked by a high percentage by mass of Fe in the alloy phase and by a Si-rich oxide film formed on the grain surface, had high specific magnetic permeability and saturated magnetic flux density as well as excellent insulating property.

Example 5

In Examples 5 and 6, magnetic alloy powders were manufactured by changing the temperature at which to heat-treat the material powder, in order to examine the impact of the heat treatment temperature on the element distributions in the magnetic grain.

The magnetic alloy powder pertaining to Example 5 was obtained in the same manner as in Example 1, except that the heat treatment temperature was changed to 700° C.

When the obtained magnetic alloy powder was measured, according to the same method in Example 1, for the percentage by mass of each element in the alloy phase of the magnetic grain constituting the powder, Fe accounted for 98.1 percent by mass, Si accounted for 1.0 percent by mass, Cr accounted for 0.7 percent by mass, and Al accounted for 0.2 percent by mass.

Also, when the obtained magnetic alloy powder was measured, according to the same method in Example 1, for the percentage by mass of each element in the oxide film of the magnetic grain constituting the powder, it was confirmed that, at the measurement position where the content of Si was the highest, Si was the element contained in the largest quantity and that Cr and Al were also contained at this measurement position.

Example 6

The magnetic alloy powder pertaining to Example 6 was obtained in the same manner as in Example 1, except that the heat treatment temperature was changed to 750° C.

When the obtained magnetic alloy powder was measured, according to the same method in Example 1, for the percentage by mass of each element in the alloy phase of the magnetic grain constituting the powder, Fe accounted for 98.3 percent by mass, Si accounted for 1.1 percent by mass, Cr accounted for 0.4 percent by mass, and Al accounted for 0.2 percent by mass.

Figure 6:
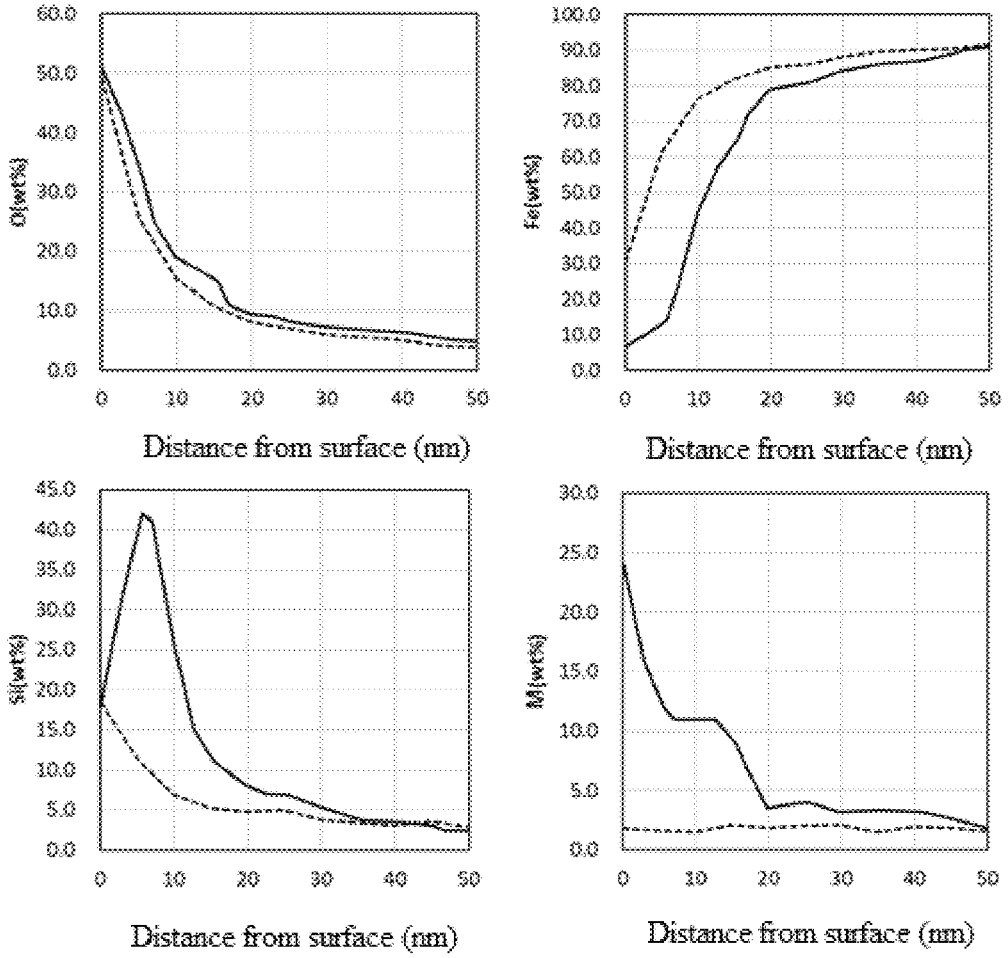
FIG. 6 is Results of element distributions in the oxide film as measured in the direction of film thickness, regarding the magnetic alloy powder and material powder pertaining to Example 6 (Solid lines: magnetic alloy powder, Dotted lines: material powder)

Also, the obtained magnetic alloy powder, and the material powder used, were each measured, according to the same method in Example 1, for the percentage by mass of each element in the oxide film of the magnetic grain constituting the powder. The results are shown in FIG. 6. In the figure, the results of the magnetic alloy powder pertaining to Example 6 are shown by solid lines, while the results of the material powder used are shown by dotted lines. These results confirmed that, at the measurement position where the content of Si was the highest (near 6 nm from the surface) according to the element distributions in the thickness direction, this content of Si was higher than the content of Fe and the content of element M (total quantity of Cr and Al), and that element M was contained at this measurement position.

From comparing Examples 1, 5 and 6, it was confirmed that the higher the heat treatment temperature, the higher the content percentage of Fe in the alloy phase of the magnetic grain became. From this result, it is argued that, by increasing the heat treatment temperature to the extent that excessive oxidation of Fe does not occur, the content percentage of Fe in the alloy phase can be increased and the magnetic saturation properties can be improved.

Example 7

In this example, it was confirmed that, even when only one type of element M is contained in the material powder, a magnetic alloy powder having a desired fine structure can still be obtained.

The magnetic alloy powder pertaining to Example 7 was obtained in the same manner as in Example 1, except that a magnetic alloy having a composition of 96.5 percent by mass of Fe, 2 percent by mass of Si, and 1.5 percent by mass of Cr, was used as the material powder.

When the obtained magnetic alloy powder was measured, according to the same method in Example 1, for the percentage by mass of each element in the alloy phase of the magnetic grain constituting the powder, Fe accounted for 98.3 percent by mass, Si accounted for 1.0 percent by mass, and Cr accounted for 0.7 percent by mass.

Also, when the obtained magnetic alloy powder was measured, according to the same method in Example 1, for the percentage by mass of each element in the oxide film of the magnetic grain constituting the powder, it was confirmed that, at the measurement position where the content of Si was the highest, Si was the element contained in the largest quantity and that Cr was contained at this measurement position.

INDUSTRIAL APPLICABILITY

The present invention provides a magnetic alloy powder having a high Fe content in the alloy phase and also offering excellent insulating property. The magnetic alloy powder is useful in that it can form magnetic bodies of excellent magnetic properties as well as high-performance coil components. Also, a preferred mode of the present invention where the oxide film contains element M, is useful in that Fe in the alloy phase does not oxidize easily and therefore stable magnetic properties can be achieved.

We claim:

1. A coil component that includes a coil part constituted by a metal conductor and a magnetic base body containing magnetic alloy grains, wherein the magnetic alloy grains are each constituted by an alloy phase coated with an oxide film which is constituted by an oxide of the alloy phase, wherein:

a boundary between the alloy phase and the oxide film is formed wherein the oxide film covers the alloy phase, wherein, in a Fe-concentration distribution in a depth direction from a surface of each magnetic alloy grain, the oxide film has an Fe-concentration increase rate in the depth direction from the surface, which is high, and the alloy phase has an Fe-concentration increase rate in the depth direction from the boundary, which is low, as compared with each other, the alloy phase has a Fe content of 98 percent by mass or higher and also contains Si and at least one of non-Si elements that oxidize more easily than Fe wherein the non-Si elements are collectively referred to as element M; and the oxide film is constituted in a manner that, not throughout the oxide film entirely in a film thickness direction but at a location where a content of Si as expressed in percentage by mass in element distributions in a film thickness direction is highest, the content of Si is higher than a content of Fe, and also higher than a content of element M.

2. A circuit board on which the coil component of claim 1 is mounted.

3. The coil component according to claim 1, wherein the oxide film is constituted in a manner that its total content of Si throughout the oxide film in the depth direction is higher than its total content of Fe, and also higher than its total content of element M throughout the oxide film in the depth direction.

4. The coil component according to claim 1, wherein the oxide film contains element M.

5. The coil component according to claim 1, wherein the oxide film contains Si, and all of element M that is contained in the alloy phase, throughout the film in its entirety.

6. The coil component according to claim 1, wherein the at least one of element M is at least one of Cr, Al, Ti, Zr, and Mg.

7. The coil component according to claim 1, wherein the at least one of element M includes Cr.

* * * * *